US005149031A

United States Patent [19]

Henri

[11] Patent Number: 5,149,031

[45] Date of Patent: Sep. 22, 1992

[54] TRASH CAN HOLDER

[76] Inventor: Jacques Henri, 950 Saint-Luc Blvd., Saint-Luc, Canada, J0J 2A0

[21] Appl. No.: 681,956

[22] Filed: Apr. 8, 1991

[51] Int. Cl.[5] ..... B65F 1/00

[52] U.S. Cl. ..... 248/131; 248/907

[58] Field of Search ..... 248/131, 128, 146, 149, 248/150, 154, 225.1, 349, 346, 907, 186; 220/401, 402, 908, 636, 628, 476, 480

[56] References Cited

U.S. PATENT DOCUMENTS

| | | | |
|---|---|---|---|
| 2,482,278 | 9/1949 | Koerner | 248/907 X |
| 2,529,780 | 11/1950 | Miller | 248/415 X |
| 2,627,824 | 2/1953 | Schulze | 220/401 X |
| 2,910,219 | 10/1959 | Bennett et al. | 248/146 X |
| 4,069,997 | 1/1978 | Weiss | 292/674 |
| 4,105,412 | 8/1978 | Petzinger | 220/908 X |
| 4,130,103 | 12/1978 | Zimmerman | 220/401 X |

FOREIGN PATENT DOCUMENTS

| | | | |
|---|---|---|---|
| 207175 | 2/1909 | Fed. Rep. of Germany | 220/636 |

*Primary Examiner*—Alvin C. Chin-Shue
*Attorney, Agent, or Firm*—Pierre Lespérance

[57] ABSTRACT

This holder is mainly used on city streets. It has a cylindrical wall provided with a bottom closure supported by a stand adapted to be fixed onto a sidewalk or the like. The stand has a top plate on which the bottom closure rests and is transversely shiftable and rotatable relative to the same. An annular flange is spacedly fixed to the underside of the bottom closure and slidably engages the underside of the stand top plate to prevent tilting of the holder while allowing its shifting and rotation movement. The cylindrical wall of the holder is made of a sheet of rubber recycled from used tires and bent into a cylindrical shape, the sheet being maintained in said shape by an upright member, of H-shaped cross-section, defining opposite channels receiving the adjacent parallel upright edge portions of the sheet and by straps surrounding the sheet and secured to the upright member. The upright member is secured to and upstands from the bottom closure.

14 Claims, 4 Drawing Sheets

TRASH CAN HOLDER

FIELD OF THE INVENTION

The present invention relates to a trash can holder mainly used on city streets.

BACKGROUND OF THE INVENTION

Trash cans as used on city streets are generally removably supported in a holder which is itself either fixedly mounted on a stand fixed to the sidewalk surface or attached to a lamp post, or the like, so that the trash can can be easily removed and emptied by city employees. Such holders are often subjected to damage, especially in cities located in northern climates where snow-clearing equipment is used during the wintertime. Such equipment including narrow endless track vehicles equipped with a front-mounted snow plow adapted to travel on sidewalks; such vehicles often hit the trash can holders. Such holders are often made of steel straps with or without spaced upright wood slats, and thus can be easily deformed or broken by the snow plows. Considerable upkeep expenses are therefore incurred by the city administration.

OBJECTS OF THE INVENTION

It is therefore the general object of the present invention to provide a trash can holder which has a considerably improved resistance to damage from colliding vehicles.

Another object of the present invention is to provide a trash can holder of the character described, so supported as to be transversely shiftable and rotatable upon impact by a moving object or vehicle, so as to decrease or absorb the impact shock to a degree sufficient to avoid damage to the holder.

Another object of the present invention is to provide a trash can holder of the character described, using a flexible, resilient sheet of elastomeric material as a side wall to form a shock-absorbent surface and also to form a wall which will have a very long useful life and which has decorative characteristics.

SUMMARY OF THE INVENTION

The side wall of the trash can holder of the invention is preferably formed by a transversely-bent flexible resilient sheet, made of elastomeric material, preferably reclaimed rubber as obtained from used automobile tires. The sheet is bent into a cylindrical shape, with adjacent parallel edge portions disposed upwardly, the lower edge of the cylindrical wall rests on a bottom closure plate and retaining means are fixed to the bottom closure plate to retain the sheet in the cylindrical shape. A stand, adapted to be fixed onto a supporting surface, includes an upright stem and a top plate fixed to the upper end of said stem, the bottom closure plate resting on the top plate and transversely shiftable and rotatable relative to the latter. The holder further includes confining means secured to the underside of the bottom closure plate and underlapping the underside of the top plate of the stand to prevent tilting of said bottom closure plate and, consequently, of said side wall with respect to said upright stem. The confining means preferably includes a collar fixed to and protruding from the underside of the bottom closure plate and an annular flange fixed to and radially inwardly extending from said collar and parallel to and spaced from said bottom closure plate a distance about equal to the thickness of said top plate of said stand. The annular flange defines a circular opening co-axial with the bottom closure plate and of a diameter greater than but less than the diameter of said top plate, said collar having a diameter greater than that of said top plate, the latter extending between said bottom closure plate and said flange and said upright stem extending through said circular opening. This arrangement allows, as indicated above, transverse shifting and rotation of the cylindrical wall relative to the base upon an impact received by the cylindrical wall to thus decrease and absorb the shock imparted to the holder, resulting in the avoidance of damage to the latter. Preferably, the bottom closure plate has drainage openings for any liquid which may accumulate in the holder and said openings can be brought into vertical register with the screw-receiving holes made in the bottom plate of the base, so that a screwing tool extending within the cylindrical wall and accessible to workmen at the top of the cylindrical wall, can be made to reach screws and the screw holes, so as to screw and unscrew the same from the top of the holder.

The retaining means for retaining the sheet in its cylindrical shape preferably include an upright member, of H-shaped cross-section, fixed to and upstanding from said bottom closure plate at the periphery of the latter, said member defining oppositely-directed channels, each receiving and guiding one of the two parallel edge portions of the sheet. The retaining means preferably further includes circular bands or straps fixed to said H-shaped member and located at vertically-spaced zones along the latter, said bands surrounding the circular wall, the lowest band fixed to the periphery of said bottom closure plate and upwardly protruding therefrom. Preferably, the lowest band also protrudes downwardly from said bottom closure to provide a good grasp for a workman wishing to transport the holder. Preferably, the H-shaped upright member has a cross-leg formed by two spaced wall portions defining a third channel opening at the outer face of the cylindrical wall, so that a conventional stake, of T-shaped cross-section, can have its main leg fitted within said third channel with the stake attached to the H-shaped member and driven into the ground to keep the holder in vertical position.

BRIEF DESCRIPTION OF THE DRAWINGS

In the annexed drawings:

FIG. 7 is a side elevation of the holder without a stand and attached to a lamp post or the like.

In the drawings, like elements indicate like elements throughout.

DETAILED DESCRIPTION OF THE INVENTION

Figure 1:
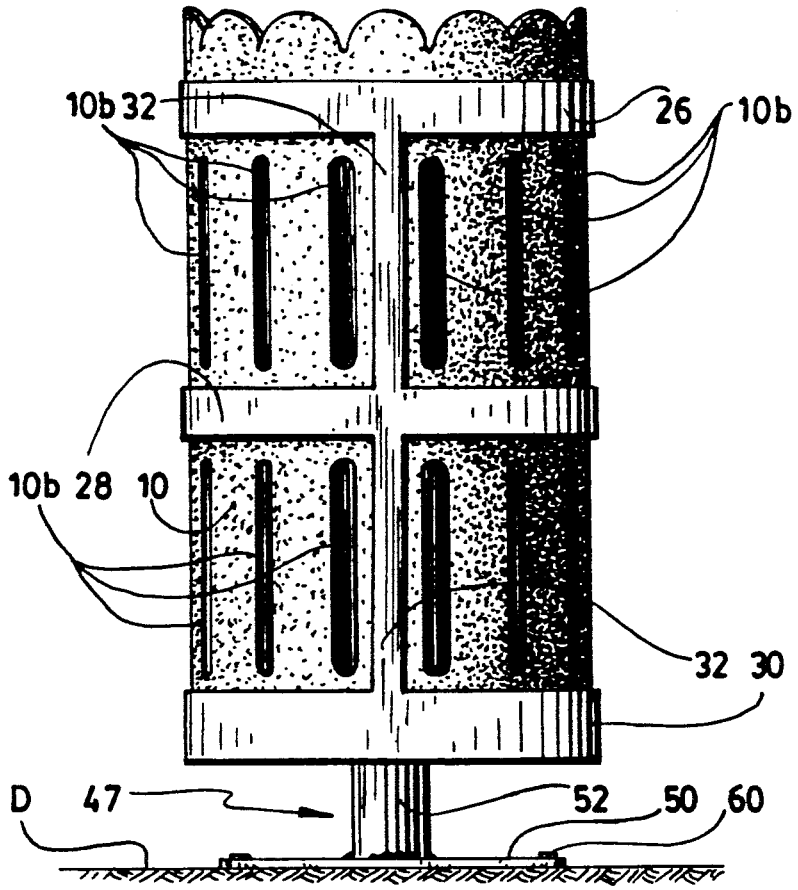
FIG. 1 is a side elevation of the trash can holder of the invention.

The trash can holder of the invention is shown in FIG. 1 and comprises a resilient, flexible sheet 10, of elastomeric material, preferably reclaimed rubber as obtained from used vehicle tires. The sheet 10 may have a thickness between one-half inch and one inch and it has a rectangular shape when laid flat.

Figure 4:
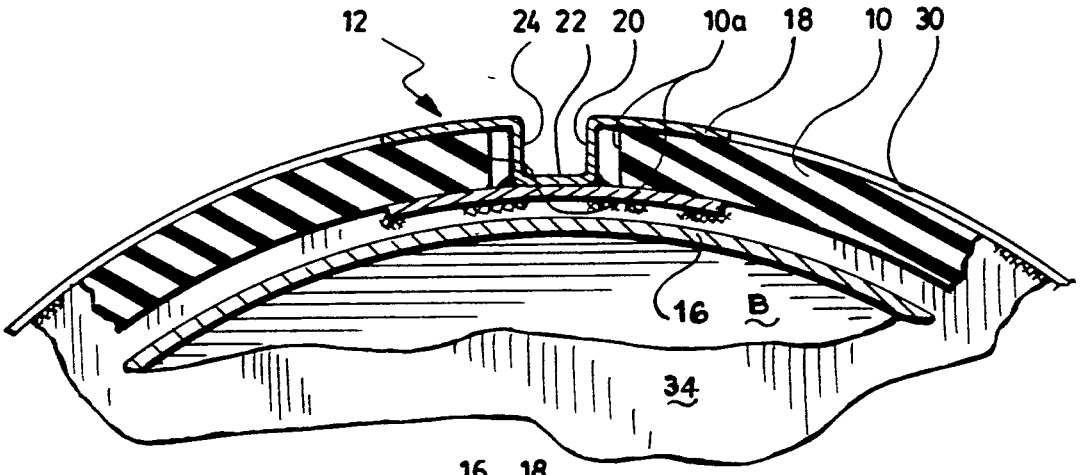
FIG. 4 is a partial plan section, taken along line 4—4 of FIG. 3.
Figure 5:
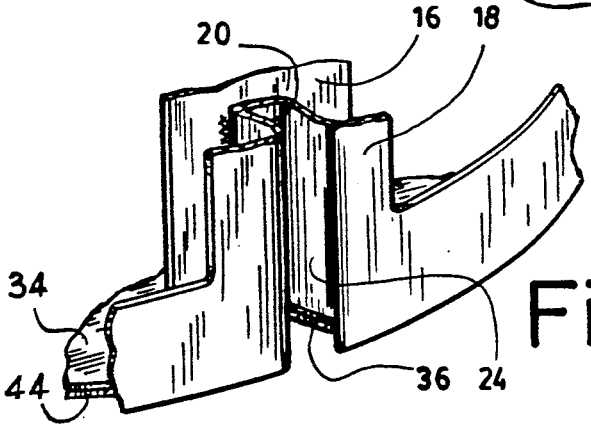
FIG. 5 is a partial perspective view of the area delimited by circle 5 in FIG. 6.
Figure 6:
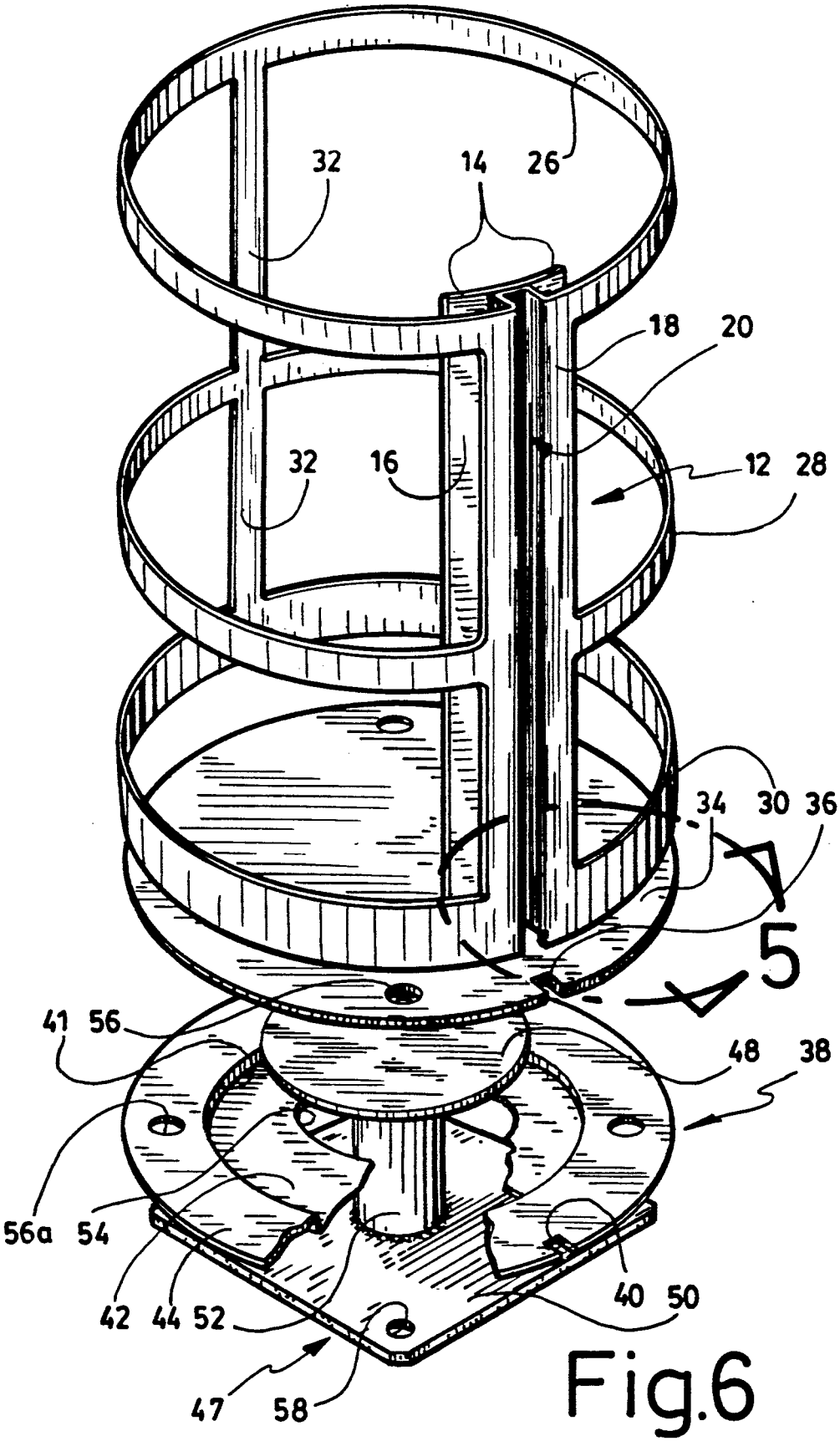
FIG. 6 is an exploded perspective view of the holder, but without the cylindrical wall formed by the sheet of elastomeric material.

The sheet 10 is maintained in curved, cylindrical shape with its adjacent edge portions 10A (see FIG. 4) maintained vertical and in close relationship by means of an upright sheet metal member 12, of H-shaped cross-section, which defines oppositely-directed channels 14 in which the marginal edge portions 10A of the sheet 10 are inserted and guided. As shown in FIG. 4, upright member 12 is preferably made of two strips of sheet metal, namely: an inner strip 16 transversely curved in accordance with the radius of curvature of the sheet 10, and an outer strip 18 also transversely curved and which also transversely curved and is centrally longitudinally depressed to form a third channel 20, which opens outwardly of the holder. The portion of the outer strip forming the third channel 20 includes a channel bottom 22 which is welded or otherwise secured to the central part of the inner strip 16 and two side walls 24 which are spaced apart and correspond to the transverse leg of the H formed by upright member 12.

The wall portions forming the third channel 20 serve to reinforce the upright member 12 and also serve to receive the main leg of a T-shaped stake, of conventional construction, not shown, which may be driven into the ground to hold the holder in upright position, the stake being secured by flexible strapping to the upright member 12.

Rigid sheet metal bands or straps 26, 28, and 30 are secured as by welding to the outer ends of the outer strip 18 at vertically-spaced zones along the upright member 12. The straps 26, 28, and 30 form three rings, of a diameter such as to frictionally engage the outside of the sheet 10 and further retain the same in cylindrical shape. The upper strap 26 extends just below the upper edge of the sheet 10; the intermediate strap 28 extends at about the mid-height of the sheet 10; and the lower strap 30 is preferably wider than the two upper straps and surround the bottom portion of the sheet 10. A vertical strip 32 interconnects the three straps 26, 28, and 30 at zones thereof diametrically opposite the upright member 12. Strip 32 maintains the three straps 26, 28, 30 in their intended horizontal position.

Figure 3:
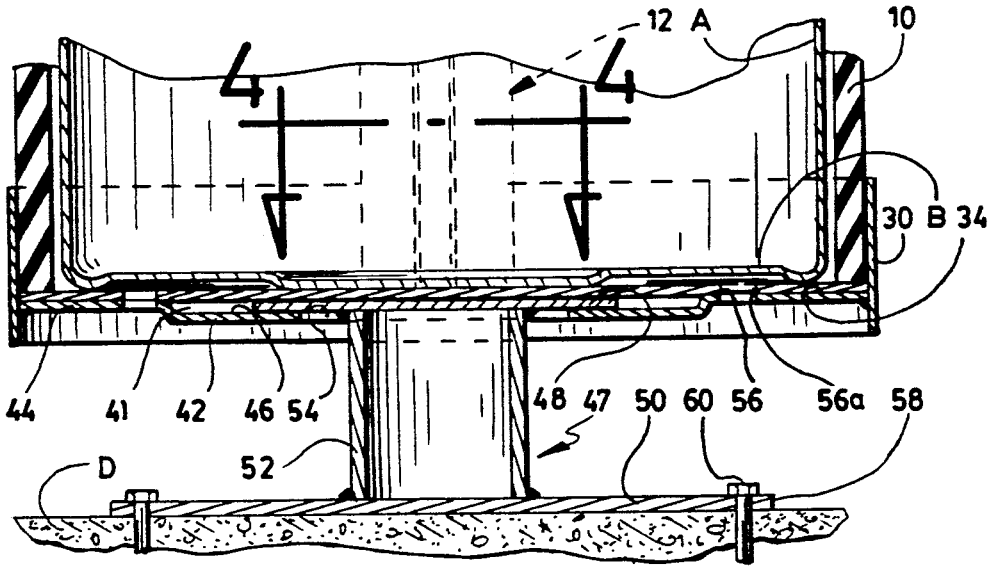
FIG. 3 is a partial vertical section, taken along line 3—3 of FIG. 2.

A bottom closure plate 34, of circular shape, is secured as by spot welding at its periphery to the bottom strap 30 along a zone such that the strap 30 projects not only upwardly from the bottom closure plate to surround sheet 10, as shown in FIG. 3, but also protrudes downwardly from closure plate 34, so as to provide a grasp for a workman to better easily transport the trash can holder.

The closure plate 34 is secured within the lower strap 30 in such an orientation that its peripheral notch 36 be in register with the third channel 20 of the upright member 12. A second dish-shaped circular plate 38 is secured to the underside of the closure plate 34. It has the same diameter as the latter and is also provided with a notch 40 in alignment with the notch 36 of plate 34. Second plate 38 can be defined by a collar 41 from the lower edge of which radially, inwardly extends an annular flange 42 and from the upper edge of which radially, outwardly extends an upper annular flange 44. In an alternate embodiment, the upper flange 44 could be dispensed with, with the top edge of collar 42 directly secured to the underside of the closure plate 34. The latter, together with the lower flange 42, are spaced apart and form a cavity 46 in which is slidably received the top plate 48 of a stand 47 comprising a base plate 50 and an intermediate tubular stem 52. The top plate 48 and the base plate 50 are secured in spaced parallel relationship to the top and bottom end of the stem 52, respectively.

Collar 41 and top plate 48 have preferably a circular shape. Annular flange 42 defines a circular central opening 54, through which stem 52 extends. The top plate 48 is located within cavity 46 in frictionally-slidable contact with the underside of the bottom closure plate 34 and the top side of the lower flange 42. The diameter of top plate 48 is greater than the diameter of central opening 54, but less than the diameter of collar 41, so that the top plate cannot be removed from its engagement within cavity 46, but the closure plate 34 and, consequently, the entire trash can holder is free to be laterally shifted and rotated relative to the top plate 48, while the holder remains in upright position.

In the embodiment shown in FIG. 3, the lateral shifting of the closure plate relative to the stand 47 is stopped when stem 52 makes contact with the edge of the central opening 54.

Figure 2:
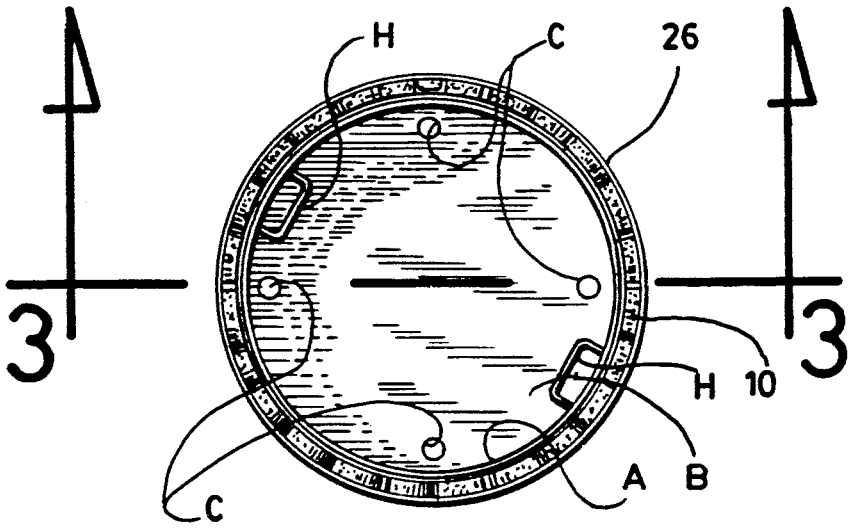
FIG. 2 is a top plan view of the same showing the trash can within the holder.

The above-noted arrangement whereby the cylindrical wall 10, together with bottom closure plate 34 with the assembly of the upright member 12 and straps 26, 28, 30, can be bodily rotated and/or shifted upon impact with respect to stand 47, has been found to greatly diminish damage to the trash can holder which might be caused by an impact of a motorized snow-plow or the like. The shock is absorbed due to the lateral shifting which is usually combined with a rotation of the above-noted assembly with respect to the stand 47, due to the fact that in most cases, the resultant of the impact is laterally offset with respect to the vertical axis of the trash can holder. The arrangement is such that the holder is always maintained in upright position, since the depth of the cavity 46 is substantially equal to the thickness of the top plate 48. Usually a snow plow hits the holder at the level of lowest strap 30 or just above. Normally, the cylindrical trash can A, which is inserted within and removed from the holder by means of its handles H, as shown in FIG. 2, is provided with drainage openings C, such openings avoiding any accumulation of liquid, such as rain, within the can A. In the same manner, the bottom closure plate 34, together with the upper flange 44, are provided with drainage openings 56, 56*a* to drain any liquid out of the holder.

Base plate 50 is normally rectangular in shape and provided at its four corners with holes 58 for receiving screws 60 used to fix the base plate 50 onto a supporting surface, such as a sidewalk D.

In accordance with a feature of the invention, the drainage openings 56, made in plates 34, 38, are disposed so that they may be brought into vertical register with the base plate holes 58, so that a suitable tool may be inserted by the workman through the open end of the holder through the drainage openings 56, 56*a* so as to gain access to the screws 60 within the holes 58, so as to screw the same into the sidewalk surface in the same manner, the screws 60 may be removed. This permits city workmen to more conveniently fix and remove the holder to and from the sidewalk. Obviously, this operation is made with the trash can A out of the holder.

Figure 8:
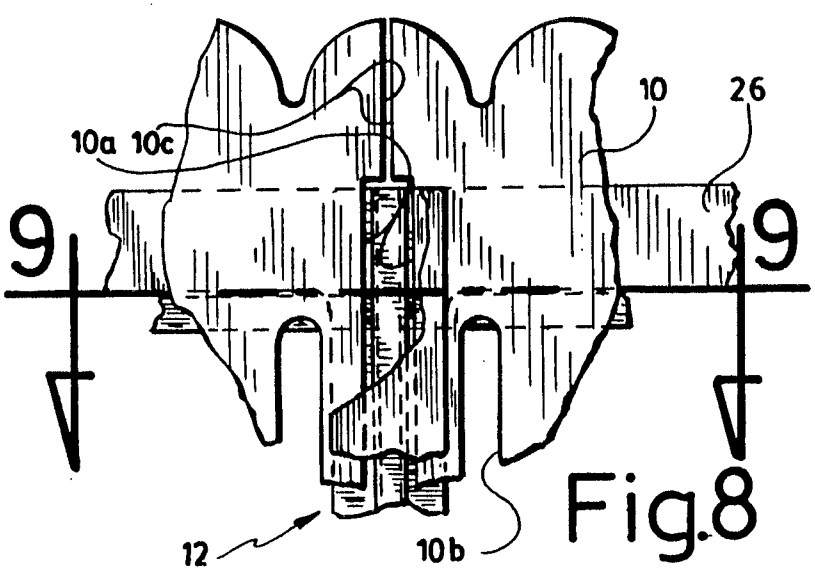
FIG. 8 is a partial view, taken along line 8—8 of FIG. 7.
Figure 9:
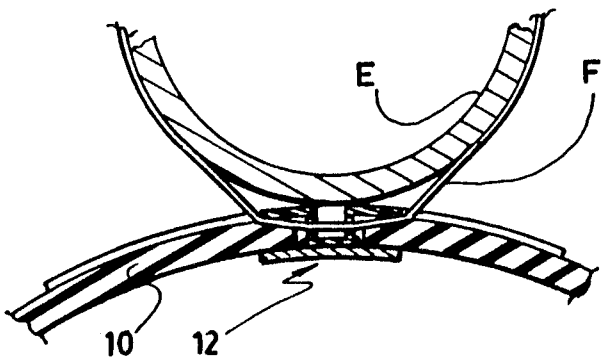
FIG. 9 is a partial plan section, taken along line 9—9 of FIG. 8.
Figure 7:
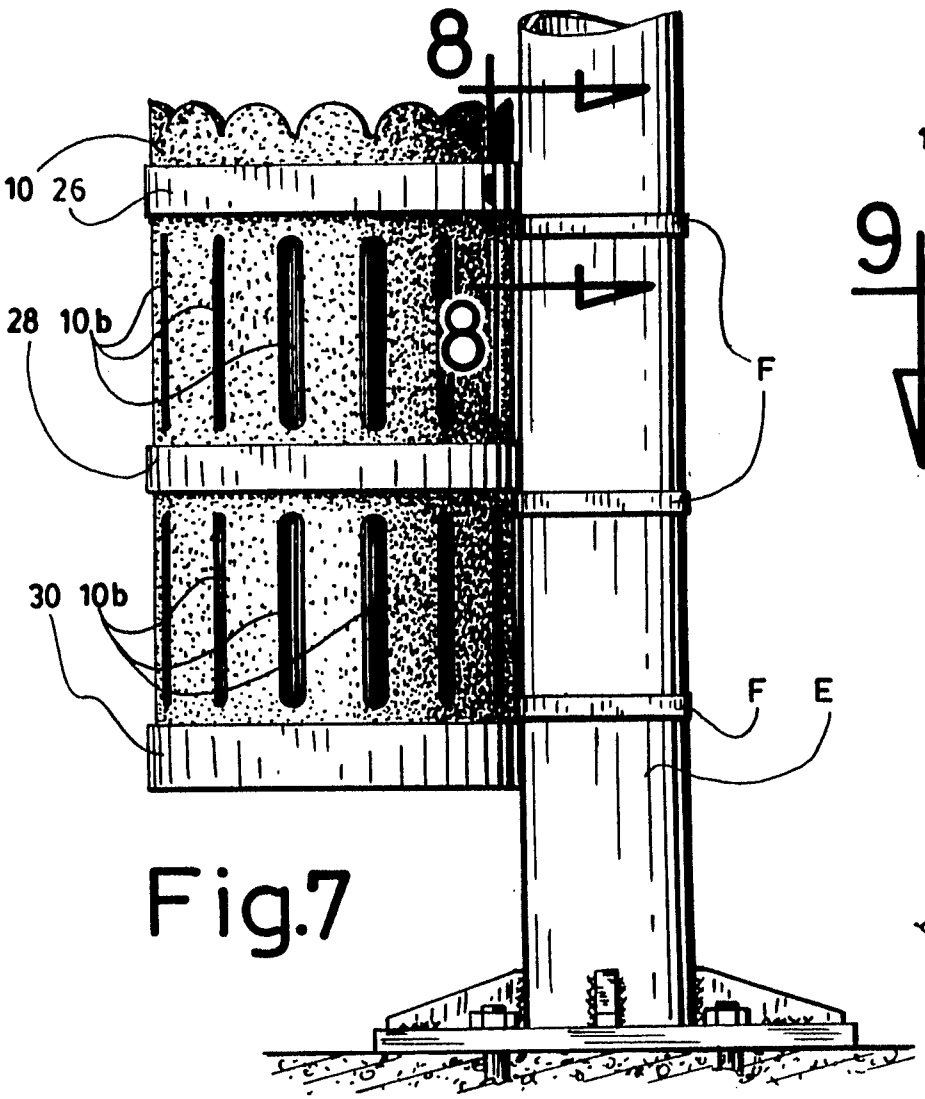

Referring to FIGS. 7 to 9, it is seen that the trash can holder without the stand 47 can be directly secured to a lamp post E or the like by means of flexible steel straps F, which surround the post and extend, as shown in FIG. 9, through slots made in the walls 24 of the outer strip 18 of the upright member 12, and on the outside of the edge portions 10A of the sheet 10. Straps F are clipped together at their ends by means of standard clips, not shown. Obviously, the complete trash holder, including its stand, as shown in FIG. 1, could be secured in the same manner to a lamp post 8 or the like, with the base plate 50 of the stand directly on the ground.

FIG. 8 shows also that the vertical edges 10A of the sheet 10 can be in the form of a cut-out, so as to enable the vertical edge portions 10C of the sheet above the upright member 12 to be close together.

I claim:

1. A trash can holder comprising an upright side wall of circular cross-section and a circular, bottom closure plate, a stand adapted to be fixed onto a supporting surface and including an upright stem and a circular top plate fixed to the upper end of said stem, said bottom closure plate resting flat and slidable on said top plate, a first annular flange surrounding said stem, underlying and in slidable contact with the underside of said top plate and defining a circular opening co-axial with said bottom closure plate and of a diameter smaller than the diameter of said top plate and greater than the cross-sectional size of said stem, spacer means fixing said first annular flange to the underside of said bottom closure plate and arranged in a circle co-axial with said circular opening and having a diameter greater than that of said top plate, said bottom closure plate transversely shiftable and rotatable relative to said top plate, while being prevented from tilting relative to said top plate and said upright stem.

2. A trash can holder as defined in claim 1 wherein said side wall is formed of a transversely-bent, flexible, resilient rectangular sheet made of elastomeric material and having adjacent parallel edge portions disposed upwardly, the bottom edge of said cylindrical wall resting on said bottom closure plate, and retaining means fixed to said bottom closure plate retaining said sheet in said cylindrical shape.

3. A trash can holder as defined in claim 1, wherein said bottom closure plate has liquid drainage openings located radially outwardly of said collar.

4. A trash can holder as defined in claim 1, wherein said spacer means further includes a generally cylindrical collar joined to and upstanding from said first annular flange and a second annular flange joined to and radially outwardly extending from said collar, said second annular flange outwardly offset from said first annular flange and applied flat againg the underside of said bottom closure plate, and fixed to the latter.

5. A trash can holder as defined in claim 3, wherein said stand has a bottom plate fixed to the lower end of said upright stem and parallel to said top plate, said bottom plate having holes for receiving screws to fix the stand to a supporting surface, said drainage openings vertically registrable with said bottom plate holes to enable access to screws within said holes by a tool extending within said cylindrical wall and accessible to a workman at the top of said cylindrical wall.

6. A trash can holder as defined in claim 2, wherein said retaining means includes an upright member of H-shaped cross-section, fixed to and upstanding from said bottom closure plate at the periphery of the latter, said H-shaped member defining oppositely-directed channels, each receiving and guiding one of the two parallel edge portions of said sheet.

7. A trash can holder as defined in claim 6, wherein said retaining means further includes circular bands fixed to said H-shaped member at vertically-spaced zones along the latter and surrounding said cylindrical wall, the lowest band fixed to the periphery of said bottom closure plate and upwardly protruding therefrom.

8. A trash can holder as defined in claim 7, wherein the lowest band protrudes downwardly from said bottom closure plate.

9. A trash can holder as claimed in claim 7, wherein said H-shaped upright member has a cross-leg formed by two spaced parallel wall portions defining a third channel opening at the outer face of said cylindrical wall.

10. A trash can holder comprising an upright side wall, of cylindrical shape, formed by a transversely-bent flexible resilient rectangular sheet, made of elastomeric material, and having adjacent parallel edge portions disposed upwardly, a bottom closure plate for said cylindrical wall and on the peripheral portion of which the bottom edge of said cylindrical wall rests, and retaining means fixed to said bottom closure for retaining said sheet in said cylindrical shape, said retaining means including an upright member, of H-shaped cross-section, fixed to and upstanding from said bottom closure plate at the periphery thereof, said H-shaped member defining oppositely-directed channels, each receiving and guiding one of the two parallel edge portions of said sheet.

11. A trash can holder as defined in claim 10, wherein said retaining means further includes circular bands fixed to said H-shaped member at vertically-spaced zones along the latter and surrounding said cylindrical wall, the lowest band fixed to the periphery of said bottom closure plate and upwardly protruding therefrom.

12. A trash can holder as defined in claim 11, wherein said lowest band protrudes downwardly from said bottom closure plate.

13. A trash can holder as defined in claim 12, wherein said H-shaped upright member has a cross-leg formed by two spaced wall portions defining a third channel opening at the outer face of said cylindrical wall.

14. A trash can holder as claimed in claim 11, further including an upright bridging strip extending parallel to said H-shaped upright member and interconnecting the portions of all of said bands, which are diametrically opposite to said H-shaped member.

* * * * *